US010393483B2

(12) United States Patent
Lu

(10) Patent No.: US 10,393,483 B2
(45) Date of Patent: Aug. 27, 2019

(54) COMBINED FIREWORKS WITH LAUNCHING PITS AND MULTI-CHANNEL FIREPROOF STRUCTURES

(71) Applicant: Shanhe Lu, Liuyang Hunan (CH)

(72) Inventor: Shanhe Lu, Liuyang Hunan (CH)

( * ) Notice: Subject to any disclaimer, the term of this patent is extended or adjusted under 35 U.S.C. 154(b) by 0 days.

(21) Appl. No.: 15/526,251

(22) PCT Filed: Mar. 29, 2017

(86) PCT No.: PCT/CN2017/078679
§ 371 (c)(1),
(2) Date: Aug. 30, 2018

(87) PCT Pub. No.: WO2018/149022
PCT Pub. Date: Aug. 23, 2018

(65) Prior Publication Data
US 2018/0364016 A1 Dec. 20, 2018

(51) Int. Cl.
*F42B 4/20* (2006.01)
*F42B 4/24* (2006.01)
*F42B 4/04* (2006.01)

(52) U.S. Cl.
CPC ..... *F42B 4/20* (2013.01); *F42B 4/04* (2013.01); *F42B 4/24* (2013.01)

(58) Field of Classification Search
CPC ..... F42B 4/20; F42B 4/04; F42B 4/24
USPC ..... 102/358
See application file for complete search history.

(56) References Cited

U.S. PATENT DOCUMENTS 1,441,551 A * 1/1923 Adler ..... F42B 4/04 102/361
1,695,052 A * 12/1928 McMurray ..... F42B 4/20 246/477
2,389,162 A * 11/1945 McInnes, Jr. ..... F42B 4/24 89/1.1
3,280,744 A * 10/1966 Brown ..... F42B 4/20 102/358
4,012,985 A * 3/1977 Magnusson ..... F42B 4/24 89/1.818

(Continued)

*Primary Examiner* — Joshua E Freeman
*Assistant Examiner* — Bridget A Cochran
(74) *Attorney, Agent, or Firm* — Wood Herron & Evans LLP

(57) ABSTRACT

The present invention relates to a combined fireworks with launching pits and multi-channel fireproof structures comprising a body, several tubular cavities are uniformly arranged on the body with the upper ports thereof are open and the lower ports thereof are closed, inner cylinders of fireworks and propellants are arranged inside the tubular cavity, the bottom of each tubular cavity is provided with annular grooves and launching pits. The bottom surface of the body is provided with several fireproof bosses, the position of each fireproof boss corresponds to each tubular cavity in the body respectively, and recessed countersinks are arranged on the fireproof bosses, the priming holes are arranged within the recessed countersinks, one end opening of the priming hole is located on the bottom surface of the launching pit, and the other end opening of the priming hole is located in the recessed countersinks. The present invention solves the problem of directional instability and unfocused acting force of the inner cylinders of fireworks during launching. With multi-channel fireproof structures protruding from the bottom surface, this invention can also prevent crossfire during launching.

10 Claims, 9 Drawing Sheets

(56) References Cited

U.S. PATENT DOCUMENTS 5,359,918 A * 11/1994 Meili ..... F42B 4/24 102/505
5,429,053 A * 7/1995 Walker ..... F42B 4/20 102/342
6,393,990 B1 * 5/2002 Fagan ..... F41F 1/06 102/342
6,412,418 B1 * 7/2002 Shelton ..... F42B 4/06 102/349
6,851,371 B1 * 2/2005 Wah ..... F42B 4/20 102/343
7,568,431 B1 * 8/2009 Stria ..... F42B 4/18 102/202.14
7,717,041 B2 * 5/2010 Garms ..... F42B 4/00 102/335
8,720,340 B1 * 5/2014 Kendrix ..... F42B 4/20 102/342
2005/0133472 A1 * 6/2005 Deye ..... F42B 4/20 211/60.1
2005/0204911 A1 * 9/2005 Barat ..... F42B 3/26 89/1.816
2006/0164787 A1 * 7/2006 Deye ..... F42B 4/00 361/249
2007/0199469 A1 * 8/2007 Zahn ..... F42B 4/02 102/338
2011/0017086 A1 * 1/2011 Zhong ..... F42B 4/24 102/335
2011/0017087 A1 * 1/2011 Zhong ..... F42B 4/24 102/358
2014/0007787 A1 * 1/2014 Caballer Barat ..... F42B 4/20 102/357
2014/0224143 A1 * 8/2014 Li ..... F42B 4/24 102/360
2015/0300790 A1 * 10/2015 Huang ..... F42B 4/24 102/360

* cited by examiner

COMBINED FIREWORKS WITH LAUNCHING PITS AND MULTI-CHANNEL FIREPROOF STRUCTURES

FIELD OF THE INVENTION

The present invention relates to the field of fireworks technology, and more particularly to a combined fireworks with launching pits and multi-channel fireproof structures.

BACKGROUND OF THE INVENTION

With the development of the fireworks technology, sizing agents are formed by mold pressing with hydraulic machinery, molds in recent years, combined fireworks produced by forming into one-piece at one time has been widely used in industries. Shapes of the combined fireworks after formed are similar to that of the traditional combined fireworks, which shapes are generally prism, cylinder and so on. Several tubular cavities are uniformly arranged on the body of the combined fireworks, structures and functions of the tubular cavities are similar to that of the single cylinders of the conventional combined fireworks, with the upper ports of the tubular cavities are open and the lower ports of the tubular cavities are closed, inner cylinders of fireworks and propellants are arranged in the tubular cavities. The structures of the combined fireworks with a transmission mode is different from the transmission fire leading structures on the side of the traditional combined fireworks, the combined fireworks adopts priming connection wire structures on the bottom thereof. The closed end of the tubular cavities are provided with priming holes passing through the bottom surface of the body, the bottom of the body is provided with leads connected the priming holes of bottom openings, the leads are connected with each priming hole, the propellants within the above-mentioned tubular cavities are ignited through priming holes. The process of molding slurries by means of hydraulic machines and molds can be found in the Chinese Patent Publication No. CN 101377395B, issued on Apr. 11, 2012, entitled "Mold pressing outer cylinder, elastic spherical housing of fireworks and making thereof".

Combined fireworks with launching pits and multi-channel fireproof structures

However, we found in practice that this combined fireworks formed by mold pressing still has the following shortcomings: (1) the propellants are not concentrated in the tubular cavities, and the gunpowder is dispersed and not uniformly distributed at the bottom of the tubular cavities, the action area to the bottom is large when the propellants are lit, the acting force pushed the inner cylinders of fireworks upward is small, affecting the launch height of the inner cylinders of fireworks and the effect pieces thereof. (2) The inner cylinders of fireworks within the tubular cavities has an inaccurate location, and not easy to coincide with the axis of the tubular cavity, and several disadvantages such as deviation in right and left often occur, trajectory offset often occurs during launching due to the location of the lower part of the inner cylinders of fireworks is not limited, the firing effect of fireworks is affected and even including the safety thereof. (3) A closed end of the tubular cavities are provided with priming holes passing through the bottom surface of the tubular cavities of the existing combined fireworks formed by mold pressing, the bottom openings of the priming holes are located in the wiring grooves within which and between the bottom surface of the priming holes are provided with cutting grooves, the wiring grooves are sealed with glues to prevent the occurrence of crossfire. As disclosed in the authorized announcement No. CN102914223B, the date of authorized announcement on Jul. 31, 2013, entitled "Combined Fireworks Formed by Mold Pressing", which is such structures adopted by the cutting grooves and sealed by glues to prevent crossfire. But in the practical application process, we found that structures adopted by the cutting grooves and sealed by glues to prevent crossfire are not stable and reliable, because the combination of the glues filling the cutting grooves with the cutting grooves is not stable, the situations such as glue falling off and cracking often occur due to carrying, moving or vibration in the production, transportation and discharging process, especially during the process of ignition for launching, under the dual role of high temperature and airflow impact generated by burning leads and propellants and glues appear softening and cracking, and the cutting grooves can not play the role of cutting off crossfire, resulting the gunpowder and inner cylinders of fireworks inside each Combined fireworks with launching pits and multi-channel fireproof structures tubular cavity are not lit and launched according to the designed discharging procedure, the occurrence of the situation of two or more tubular cavities are almost simultaneously emitted, and the firing effect is completely destroyed.

DESCRIPTION OF THE INVENTION

The purpose of the present invention is to overcome the deficiency of the current technology and provide a new combination of fireworks.

The present invention adopts the following technical schemes.

A combined fireworks with launching pits and multi-channel fireproof structures comprising a body formed by mold pressing, several tubular cavities are uniformly arranged on the body with the upper ports thereof are open and the lower ports thereof are closed, inner cylinders of fireworks and propellants are arranged inside the tubular cavity, characterized in that the bottom of each tubular cavity is provided with launching pits improving the launch effect, and the propellants are placed in the launching pits.

Further, the bottom of the each tubular cavity is provided with annular grooves for facilitating the placement of the inner cylinders of fireworks, the bottom edges of the inner cylinders of fireworks are located within the annular grooves which surround the periphery of the launching pits.

Further, the launching pits are conical cavities on the bottom of which are provided with priming holes, and the annular grooves have U-shaped cross-sectional shapes.

Further, the bottom surface of the body is provided with several fireproof bosses, the position of each fireproof boss corresponds to each tubular cavity in the body respectively, and recessed countersinks are arranged on the fireproof bosses, the priming holes are arranged within the recessed countersinks, one end opening of the priming hole is located on the bottom surface of the launching pit, and the other end opening of the priming hole is located in the recessed countersink.

Preferably, the fireproof bosses are circular bosses, and a recessed countersink is arranged in the exact center of the circular boss within which provided with priming Combined fireworks with launching pits and multi-channel fireproof structures holes for mounting leads.

Preferably, the fireproof bosses are square-shaped bosses on which provided with two recessed countersinks, namely a first countersink and a second countersink, respectively, an incoming wire priming hole is arranged within the first countersink, and an outgoing wire is arranged within the second countersink.

Further, the square-shaped boss is consisted of a first fireproof wall, a second fireproof wall, a third fireproof wall, a left connection wall and a right connection wall, the first fireproof wall is located on the left side of the first countersink, and the second fireproof wall is located on the right side of the second countersink, the third fireproof wall is located between the first and second countersink, the two ends of the first, second and third fireproof wall are respectively connected to the left and right connection wall.

Further, a first wiring groove and a second wiring groove are respectively arranged on the top of the first and second fireproof wall of the square-shaped bosses.

Further, the square-shaped bosses is connected to the adjacent square-shaped bosses by two fireproof walls between which provided with a lead channel communicated with the first and second wiring groove respectively.

Further, the bottom surface of the lead channel is aligned with the bottom surface of the first and second wiring groove, and the lead channel is integrated with the first and second wiring groove.

The present invention has the following advantages:

The tubular cavity of the present invention is provided with an annular groove having a rectangular or U-shaped cross-section, the width of the annular edge is equal to or slightly less than the groove width of the annular groove, making the lower edges of the inner cylinders of fireworks inserted into the groove of the annular groove, and the positions of the inner cylinders of fireworks are restricted, so that the central axis of the inner cylinders of fireworks is the coaxial configuration with that of the annular groove, ensuring that the inner cylinders of fireworks is not skew on the left and right when installed in the tubular cavity, and the inner cylinders of fireworks Combined fireworks with launching pits and multi-channel fireproof structures can be launched upward vertically when the gunpowder at the bottom thereof is lit, which overcomes the shortcomings that a position is not restricted at the lower part of the inner cylinders of fireworks of the existing combined fireworks, and uncertain factors of affecting the effect and safety for discharging fireworks are eliminated, as well as the effect and safety performance of discharging fireworks are improved.

The bottom surface of the tubular cavity of the present invention is also provided with a launching pit with a recessed structure, when the propellants in the launching pit are lit by a lead, since the inner diameter of the launching pit is smaller than the inner diameter of the tubular cavity, the propellants in the launching pit are more concentrated, the rapid expansion of the high temperature gas when the gunpowder is launched has a smaller effect on launching pit, a greater concentration of force and a greater launching pressure per unit area, and the launch height is higher, the launch rate is faster with a better firing effect especially when the structure of the launching pit of the conical cavity is adopted, at the same time the effect pieces of fireworks are launched effectively traveling along the launching track due to the restriction effect on the inner cylinders of fireworks by the annular grooves.

In a preferred embodiment of the present invention, a square-shaped bosses consisted of a first fireproof wall, a second fireproof wall, a third fireproof wall, a left connection wall and a right connection wall and multiple fireproof structures of the lead connection blocks connected to the adjacent square-shaped bosses are adopted, which restrain the high temperature combustion gas released by burning leads and sparks. The first second, third fireproof wall and the left and right connection wall are obvious entity fireproof structures highlighted the bottom of the body, the fireproof effect is much better than that of the existing depression of the cross section groove structures by completely separating the incoming leads and the outgoing leads within the first and second recessed countersinks. The existing incoming leads are separated with the outgoing leads by adopting cutting grooves, the leads still can be possibly ignited by the high temperature pressure and the high temperature gas when the leads are burned through the gaps between the cutting grooves and the coagulation Combined fireworks with launching pits and multi-channel structures glue, forming the crossfire for launching, especially under the dual role of the high temperature, high pressure gas for the coagulation glue, softening and shedding is prone to occur, resulting the outgoing leads are burned directly when the incoming leads are burning and the propellants are still not ignited, and the phenomenon of crossfire appeared. The gunpowder and inner cylinders of fireworks inside the tubular cavity are not lit and launched according to the designed discharging procedure, instead of the occurrence of the situation of two or more tubular cavity is almost simultaneously emitted, and the firing effect is completely destroyed. The first, second, third fireproof wall and the left and right connection wall are formed in one-piece by pressing with the bottom of the body, the height of which highlights the bottom of the body by 2-5 mm, and the phenomenon of softening and shedding at high temperature does not occur, and there is no gap between the fireproof wall and the bottom of the body. The shortcomings of crossfire of the existing combination of fireworks are completely overcome.

Combined fireworks with launching pits and multi-channel fireproof structures

DETAILED DESCRIPTION OF THE PREFERRED EMBODIMENTS

The invention will now be described in detail further with reference to the accompanying drawings.

Embodiment 1

Figure 1:
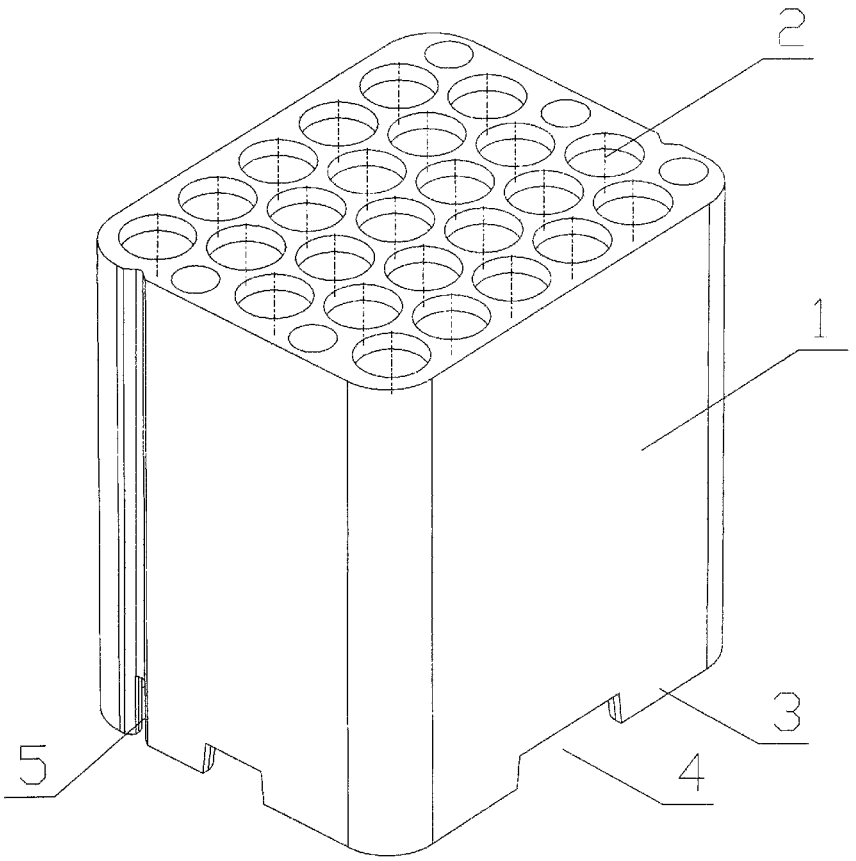
FIG. 1 is a schematic view of the overall structure of Embodiment 1.
Figure 2:
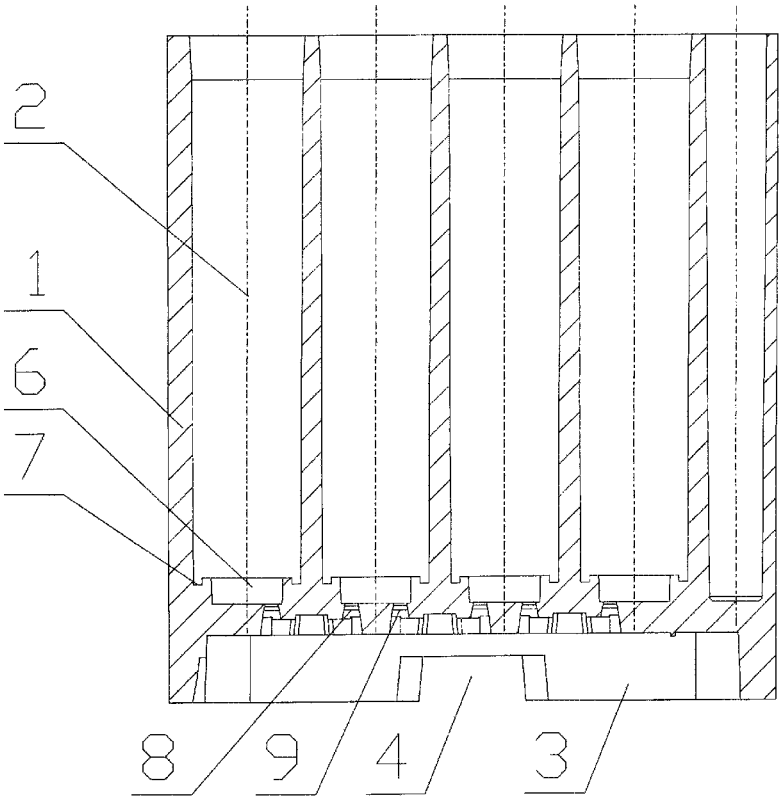
FIG. 2 is a schematic cross-sectional view of Embodiment 1.

As shown in FIG. 1 and FIG. 2, this is a kind of 25-shot combined fireworks made by the process of mold pressing with one-piece at one time. The combined fireworks formed by mold pressing comprising 25 tubular cavities 2 are parallelly and uniformly arranged on the body 1 with the upper ports thereof are open and the lower ports thereof are closed, inner cylinders of fireworks and propellants are arranged inside the tubular cavity 2, the bottom of the tubular cavity 2 (i.e a closed end of the tubular cavity 2)is provided with an annular groove 7 for facilitating the placement of the inner cylinders of fireworks an launching pit 6 improving the launch effect, the annular groove 7 surrounds the periphery of the launching pit 6, and propellants are filled in the launching pit 6. The annular groove 7 and the launching pit 6 are also formed by the process of mold pressing adopting molds and pressed together with the bottom of the tubular cavity 2. The bottom surface of the body 1 is provided with a raised frame 3 on which provided with a plurality of ventilation and pressure relief grooves 4. The side surface of the body 1 is provided with a side groove 5, and the bottom of the body 1 is fixed with a fuse using moisture-proof glues, and both ends of the fuse are led to the top of the body 1 through the side groove 5 of the body 1.

The launching pit 6 can use cavity structures such as cylindrical cavities, conical cavities or other recessed ones, the launching pit 6 is filled with propellants, and the bottom surface of the launching pit 6 is provided with priming holes passing through the bottom surface of the body 1. The priming hole adopts the structures with a launching pit 6 provided with a priming hole, and a lead connected to the bottom fuse of the body 1 is inserted into the priming hole. The priming hole can also adopt the structures with the launching pit 6 provided with two priming holes respectively are a incoming priming hole 8 and a outgoing priming hole 9, and an incoming wire and an outgoing wire are respectively inserted into the incoming priming hole 8 and the Combined fireworks with launching pits and multi-channel fireproof structures outgoing priming hole 9, the incoming wire within the launching pit 6 of the tubular cavity 2 is connected in series with the incoming wire within the launching pit 6 of another tubular cavity 2.

In this embodiment, the launching pit 6 preferably adopts a conical cavity structure, with two priming holes drilled by drills at the bottom of the conical cavity, one for the incoming priming hole 8 and the other for the outgoing priming hole 9. An annular groove 7 is provided around the conical cavity, the central axis of the annular groove 7 coincides with the central axis of the conical cavity and the central axis of the tubular cavity 2, which are coaxial structures. The lower edge of the inner cylinders of fireworks is mounted in the annular groove 7, and the shape of the annular groove 7 is matched with the shape of the lower edge of the inner cylinders of fireworks. The annular groove 7 may has a variety of shapes. In this embodiment, since the lower edge of the inner cylinders of fireworks generally adopts an annular edge, the annular groove 7 is preferably provided with a circular annular groove 7 matched thereof, the annular groove 7 has a rectangular or U-shaped cross-sectional shape, the width of the annular edge is equal to or slightly less than the groove width of the annular groove 7, making the lower edges of the inner cylinders of fireworks inserted into the groove of the annular groove 7, and the positions of the inner cylinders of fireworks are restricted, so that the central axis of the inner cylinders of fireworks is the coaxial configuration with that of the annular groove 7, ensuring that the inner cylinders of fireworks is not skew on the left and right when installed in the tubular cavity 2, and the inner cylinders of fireworks can be launched upward vertically when the gunpowder at the bottom thereof is lit, which overcomes the shortcomings that position is not restricted at the lower part of the inner cylinders of fireworks of the existing combination of fireworks, and uncertain factors of affecting the effect and safety for discharging fireworks are eliminated, as well as the effect and safety performance of discharging fireworks are improved.

The present embodiment also adopts a new structure of the launching pit 6, when the propellants in the launching pit 6 are lit by a lead, since the inner diameter of the Combined fireworks with launching pits and multi-channel fireproof structures launching pit is smaller than the inner diameter of the tubular cavity 2, the propellants in the launching pit 6 are more concentrated, the rapid expansion of the high temperature gas when the gunpowder is launched has a smaller effect on the launching pit 6, a greater concentration of force and a greater launching pressure per unit area, and the launch height is higher, the launch rate is faster with a better firing effect especially when the structure of the launching pit 6 of the conical cavity is adopted, at the same time the effect pieces of fireworks are launched effectively traveling along the launching track due to the restriction effect on the inner cylinders of fireworks by the annular grooves 7.

Embodiment 2

Figure 3:
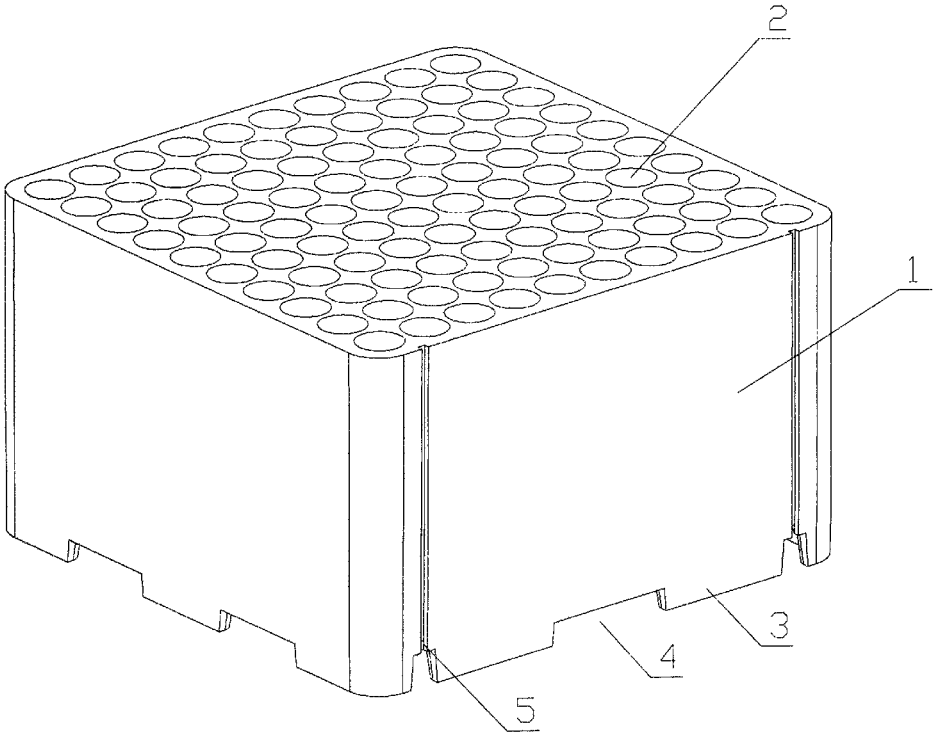
FIG. 3 is a schematic view of the overall structure of Embodiment 2.
Figure 4:
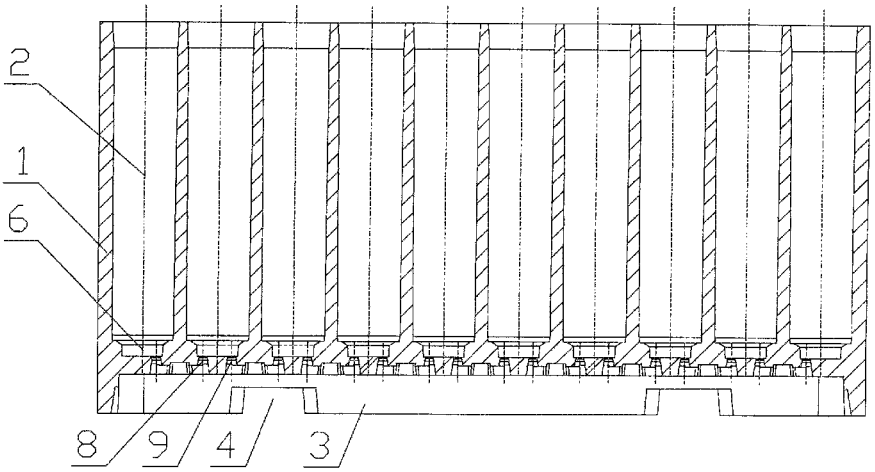
FIG. 4 is a schematic cross-sectional view of Embodiment 2.

As shown in FIG. 3 and FIG. 4, this is a 100-shot combined fireworks that is mold pressed at one time. The combined fireworks formed by mold pressing comprising 100 tubular cavities 2 are parallelly and uniformly arranged on the body 1 with the upper ports thereof are open and the lower ports thereof are closed, inner cylinders of fireworks and propellants are arranged inside the tubular cavity 2, the bottom of the tubular cavity 2 (i.e the closed end of the tubular cavity 2) is provided with a launching pit 6 improving the launch effect, and propellants are filled in the launching pit 6. The annular groove 7 and the launching pit 6 are also formed by the process of mold pressing adopting molds and pressed together with the bottom of the tubular cavity 2.

The launching pit 6 can use cavity structures such as cylindrical cavities, conical cavities or other recessed ones, the launching pit 6 is filled with propellants, and the bottom surface of the launching pit 6 is provided with a priming hole passing through the bottom surface of the body 1. The priming hole adopts the structures with the launching pit 6 provided with a priming hole, and a lead connected to the bottom fuse of the body 1 is inserted into the priming hole.

The priming hole can also adopt the structures with the launching pit 6 provided with two priming holes respectively are an incoming priming hole 8 and a outgoing priming hole 9, and an incoming wire and an outgoing wire are respectively inserted Combined fireworks with launching pits and multi-channel fireproof structures into the incoming priming hole 8 and the outgoing priming hole 9, the incoming wire within the launching pit 6 of the tubular cavity 2 is connected in series with the incoming wire within the launching pit 6 of another tubular cavity 2.

Embodiment 3

Figure 5:
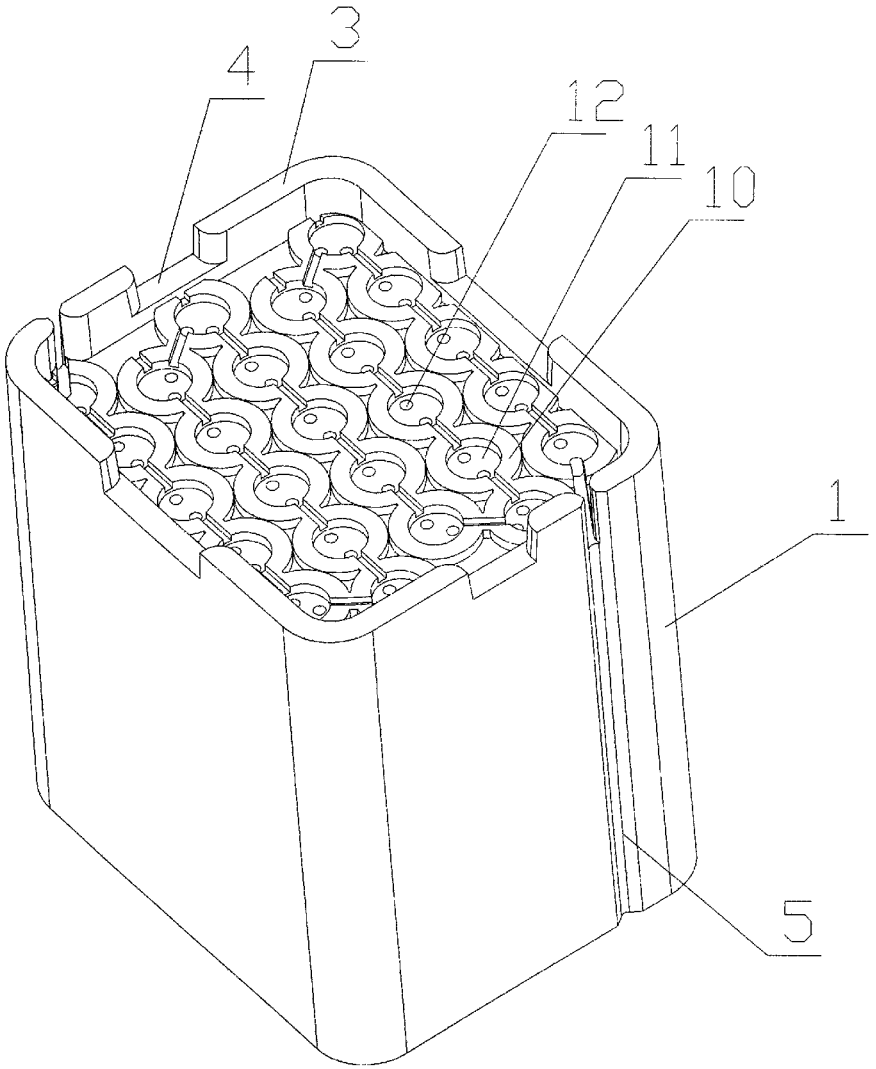
FIG. 5 is a schematic view of the three-dimensional structure of the bottom of Embodiment 3.
Figure 6:
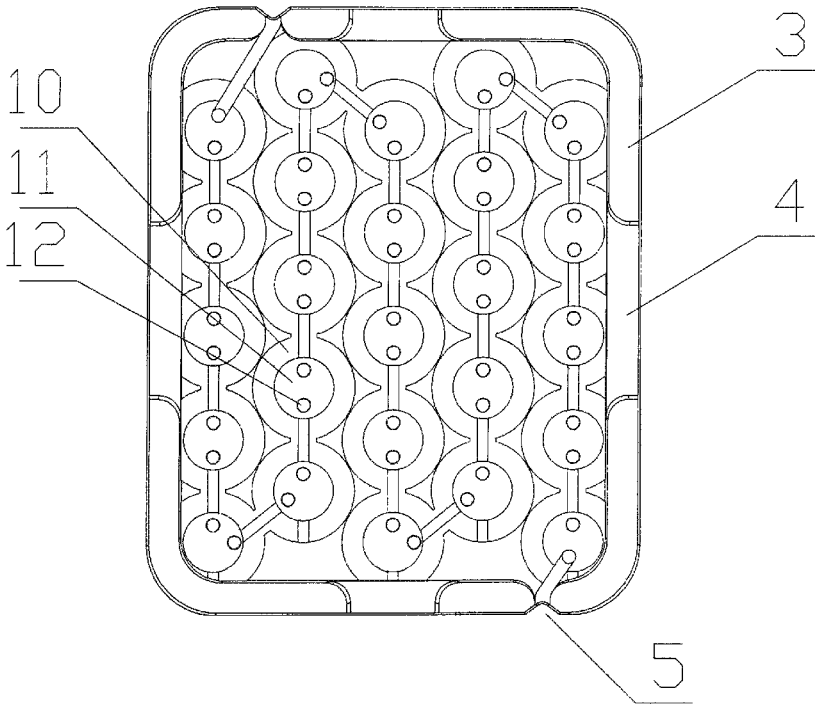
FIG. 6 is a schematic plan view of the bottom of the body of Embodiment 3.
Figure 7:
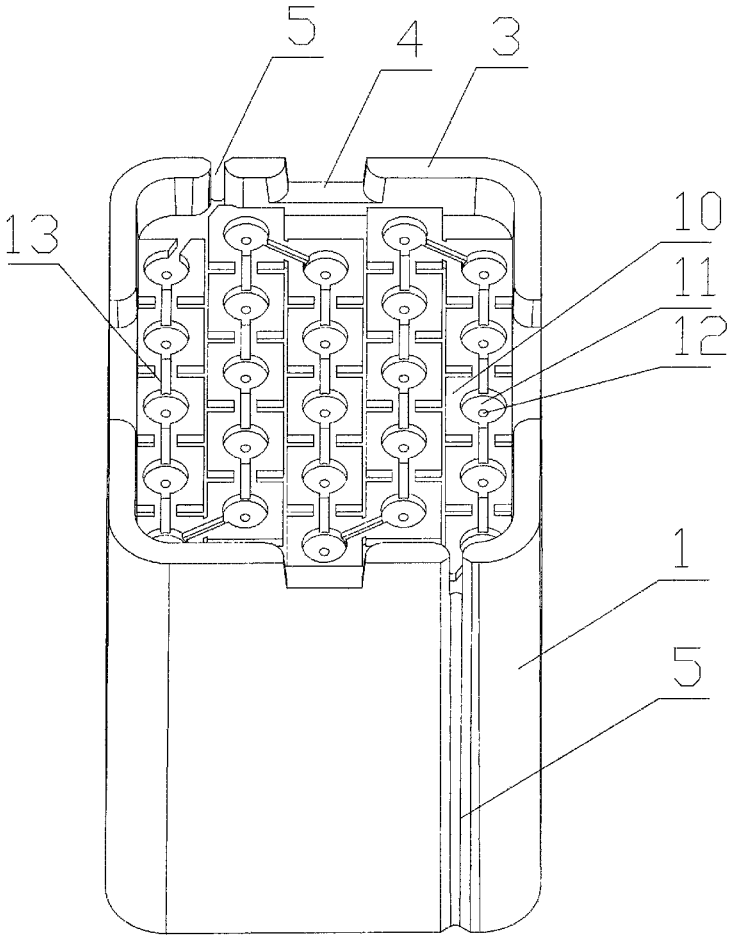
FIG. 7 is a schematic view of another three-dimensional structure of the bottom of Embodiment 3.

As shown in FIGS. 5, 6 and 7, this is another implementation structure of the present invention, and is also the 25-shot combined fireworks that is mold pressed at one time, comprising 25 tubular cavities 2 are parallelly and uniformly arranged on the body l with the upper ports thereof are open and the lower ports thereof are closed, inner cylinders of fireworks and propellants are arranged inside the tubular cavity 2, the bottom of the tubular cavity 2 is provided with a launching pit 6 around which can be provided with a launching pit 6, and the launching pit 6 is filled with propellants. The annular groove 7 and the launching pit 6 are also formed by the process of mold pressing adopting molds and pressed together with the tubular cavity 2. It is to be noted that an embodiment in which the annular groove 7 is not provided may also be used during manufacturing, which is also included within the scope of the present invention.

The difference is that the bottom surface of the body 1 is provided with several fireproof bosses, the position of each fireproof boss corresponds to each tubular cavity in the body 1 respectively in this embodiment. The fireproof bosses is an circular boss 10, the center line of the circular boss 10 is coincides with the center line of the tubular cavity 2, and one or two recessed countersinks 11 are arranged in the exact center of the circular boss 10, the circular boss 10 and the recessed countersinks 11 in the exact center are all formed together with the body 1 by mold pressing adopting molds, the used material is also consistent with that of the body 1, so that the circular boss 10, the countersink 11 and the body 1 being a one-piece structure. The recessed countersink 11 is arranged in the recessed countersinks for mounting leads. The priming hole l 2 can be drilled by drilling tools and also can be pressed by molds, the number of priming holes 12 may be one or two. One end opening of the priming hole 12 is located in the bottom surface of the launching pit 6, and the other end Combined fireworks with launching pits and multi-channel fireproof structures opening of the priming hole 12 is located in the recessed countersink 11. The leads are mounted in the priming hole 12 with the upper end of the leads passing through the countersink 11 of the fireproof bosses and connected to the propellants in the launching pit 6 at the bottom of the tubular cavity 2, the lower end of the lead is connected with the fuse on the bottom surface of the combined fireworks body 1, the fuse can be secured to the bottom of the body 1 with moisture-proof adhesives by means of inserting or winding, the lead within the recessed countersink 12 in the countersink 11 can also be fixed with moisture-proof glues.

It should be noted that, as a variation of the present invention, the contour of the circular boss 10 may be changed to a square with a countersink 11 arranged in the center thereof, and a priming hole 12 is provided within the recessed countersink 11, as shown in FIG. 7. When used, it is only necessary to fix a completed fuse to the wiring groove 13 on the bottom of the body 1 using moisture-proof glues to meet the requirements of spreading fire, each spreading hole is not needed to be inserted leads separately, the sparks of the combustion gas generated by fuses within wiring groove 13 enter the tubular cavity 2 from priming holes, and propellants and inner cylinders of fireworks are lit.

Embodiment 4

Figure 8:
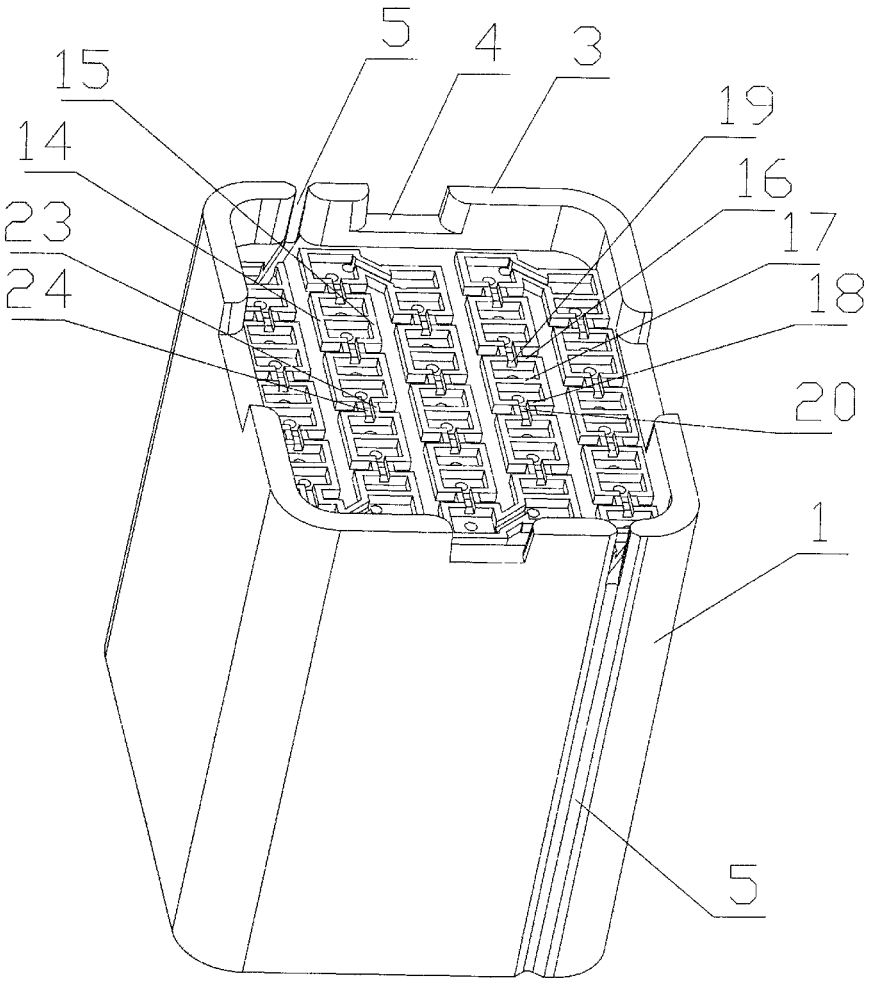
FIG. 8 is a schematic view of the three-dimensional structure of the bottom of the Embodiment 4 of the body (the state without installing leads and moisture-proof adhesives)
Figure 9:
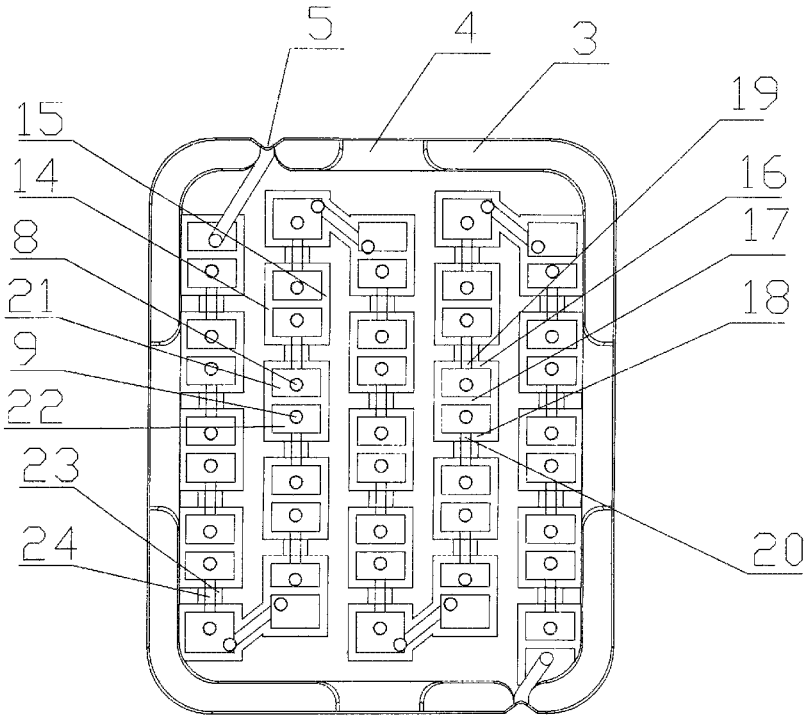
FIG. 9 is a schematic plan view of the bottom of die body of the Embodiment 4. (the state without installing leads and moisture-proof adhesives)

As shown in FIG. 8 and FIG. 9, this is another embodiment structure of the present invention, and is also a 25-shot combined fireworks that is mold pressed at one time, comprising 25 tubular cavities 2 are parallelly and uniformly arranged on the body 1 with the upper ports thereof are open and the lower ports thereof are closed, inner cylinders of fireworks and propellants are arranged inside the tubular cavity 2 the bottom of the tubular cavity 2 is provided with an annular groove 7 for facilitating the placement of the inner cylinders of fireworks a launching pit 6 improving the launch effect, the annular groove 7 surrounds the periphery of the launching pit 6, and the launching pit 6 is filled with propellants. The annular groove 7 and the launching pit 6 are also formed by the mold pressing process and pressed together with the tubular cavity 2. It is to be noted that an embodiment in which the Combined fireworks with launching pits and multi-channel fireproof structures annular groove 7 is not provided may also be used during manufacturing, which is also included within the scope of the present invention.

The bottom surface of the body 1 is provided with several fireproof bosses, the position of each fireproof boss corresponds to each tubular cavity 2 in the body 1 respectively. The fireproof bosses are square-shaped bosses on which provided with two recessed countersinks, namely a first countersink 21 and a second countersink 22 respectively, an incoming wire priming hole 8 is arranged within the first countersink, and an outgoing wire 9 is arranged within the second countersink 22.

The difference is that the square-shaped boss is consisted of a first fireproof wall 16, a second fireproof wall 17, a third fireproof wall 18, a left connection wall 14 and a right connection wall 15, the first fireproof wall 16 is located on the left side of the first countersink 21, and the second fireproof wall 17 is located on the right side of the second countersink 22, the third fireproof wall 18 is located between the first 21 and second countersink 22, the two ends of the first 16, second 17 and third fireproof wall 18 are respectively connected to the left 14 and right connection wall 15 in this embodiment. The first, second, third fireproof wall and the left and right connection wall (16,77,18,14,15,21,22) are formed in a whole by pressing with the bottom of the body 1, the used materials can be the ones consistent with the body 1, and the fireproof materials can also be used for pressing, the height of the first, second, third fireproof wall and the left and right connection wall (16,17,18,14,15,21,22) highlights the bottom of the body by 2-5 mm. The cross section may be n-type, or triangular, or rectangular, or other shapes.

The top of the first fireproof wail 16 and second fireproof wall 17 of the square bosses are provided with a first wiring groove 19 and a second wiring groove 20 which also formed by mold pressing, a first pass slot 19, a second pass slot 20 is also made by press molding, the width of the wiring groove is slightly larger than the diameter of the leads. The square-shaped bosses is connected to the adjacent square-shaped bosses by two fireproof walls 23 between which provided with a lead channel 24 communicated with the first and second wiring groove (19,20)

Combined fireworks with launching pits and multi-channel fireproof structures respectively. The bottom surface of the lead channel 24 is aligned with the bottom surface of the first and second wiring groove (19,20), and the lead channel 24 is integrated with the first and second wiring groove (19,20).

A square-shaped bosses adopted by the embodiment is consisted of a first fireproof wall 16, a second fireproof wall 17, a third fireproof wall 18, a left connection wall 14 and a right connection wall 15 and multiple fireproof structures of the two fireproof walls 23 connected to the adjacent square-shaped bosses, which restrain the high temperature combustion gas released by burning leads and sparks. The first, second, third fireproof wall and the left and right connection wall (16,17,18,14,15,21,22) are obvious entity fireproof structures highlighted the bottom of the body 1, the fireproof effect is much better than that of the existing depression of the cross section groove structures by completely separating the incoming leads and the outgoing leads within the first and second recessed countersinks (21,22). The existing incoming leads are separated with the outgoing leads by adopting cutting grooves, the leads still can be possibly ignited by the high temperature pressure and the high temperature gas when the leads are burned through the gaps between the cutting grooves and the coagulation glue, forming the crossfire for launching especially under the dual role of the high temperature, high pressure gas for the coagulation glue, softening and shedding is prone to occur, resulting the outgoing leads are burned directly when the incoming leads are burning and the propellants are still not ignited, and the phenomenon of crossfire appeared. The gunpowder and inner cylinders of fireworks inside each tubular cavity 2 are not lit and launched according to the designed discharging procedure, instead of the occurrence of the situation of two or more tubular cavity is almost simultaneously emitted, and the firing effect is completely destroyed. The first, second, third fireproof wall and the left and right connection wall (16,17,18,14,15) of the embodiment are formed in a whole by pressing with the bottom of the body 1, the height of which highlights the bottom of the body by 2-5 mm, and the phenomenon of softening and shedding at high temperature does not occur, and there is no gap between the fireproof wall and the Combined fireworks with launching pits and multi-channel fireproof structures bottom of the body 1. The shortcomings of crossfire of the existing combination of fireworks are completely overcome.

The foregoing is only a preferred embodiment of the present invention, and the scope of the present invention is not limited to the above-described embodiments. It should be noted that several modifications and modifications should be considered as the protection scope of the present invention without departing from the principles of the invention for one of ordinary skill in the art. The various components that are not explicitly defined in this embodiment may be implemented by the prior art.

The invention claimed is:

1. A combined fireworks with launching pits and multi-channel fireproof structures, comprising:

a body formed by mold pressing, and several tubular cavities uniformly arranged on the body with upper ports thereof being open and lower ports thereof being closed, wherein inner cylinders of fireworks and propellants are arranged inside the tubular cavities, wherein a bottom of each tubular cavity is provided with a launching pit for improving a launch effect, and the propellants are placed in the launching pits, and wherein the bottom of each tubular cavity is also provided with an annular groove for facilitating the placement of the inner cylinders of fireworks, such that bottom edges of the inner cylinders of fireworks are located within the annular grooves, and each annular groove is spaced from and surrounds a periphery of the corresponding launching pit at the bottom of each tubular cavity.

2. The combined fireworks with launching pits and multi-channel fireproof structures of claim 1, characterized in that the launching pits are conical cavities on the bottom of which are provided with priming holes, and the annular grooves have a U-shaped cross-section.

3. The combined fireworks with launching pit and multi-channel fireproof structures of to claim 1, characterized in that the bottom surface of the body is provided with several fireproof bosses, the position of each fireproof boss corresponds to each tubular cavity in the body respectively, and recessed countersinks are arranged on the fireproof bosses, the priming holes are arranged within the recessed countersinks, one end opening of the priming hole is located on the bottom surface of the launching pit, and the other end opening of the priming hole is located in the recessed countersink.

4. The combined fireworks with launching pit and multi-channel fireproof structures of claim 3, characterized in that the fireproof bosses are circular bosses, and a recessed countersink is arranged in the exact center of the circular bosses within which provided with priming holes for mounting leads.

5. The combined fireworks with launching pit and multi-channel fireproof structures of claim 3, characterized in that the fireproof bosses are square-shaped bosses on which provided with two recessed countersinks, namely a first countersink and a second countersink, respectively, the incoming wire priming hole is arranged within the first countersink, and the outgoing wire is arranged within the second countersink.

6. The combined fireworks with launching pit and multi-channel fireproof structures of claim 5, characterized in that the square-shaped boss is consisted of a first fireproof wall, a second fireproof wall, a third fireproof wall, a left connection wall and a right connection wall, the first fireproof wall is located on the left side of the first countersink, and the second fireproof wall is located on the right side of the second countersink, the third fireproof wall is located between the first and second countersink, the two ends of the first, second and third fireproof wall are respectively connected to the left and right connection wall.

7. The combined fireworks with launching pit and multi-channel fireproof structures of claim 6, characterized in that a first wiring groove and a second wiring groove are respectively arranged on the top of the first and second fireproof wall of the square-shaped bosses.

8. The combined fireworks with launching pit and multi-channel fireproof structures of claim 7, characterized in that each of the square-shaped bosses is connected to adjacent square-shaped bosses by two fire resisting walls between which is defined a lead channel connected with the first and second wiring groove respectively.

9. The combined fireworks with launching pit and multi-channel fireproof structures of claim 8, characterized in that the bottom surface of the lead channel is aligned with the bottom surface of the first and second wiring groove, and the lead channel is integrated with the first and second wiring groove.

10. The combined fireworks with launching pits and multi-channel fireproof structures of claim 1, further comprising:

priming holes connected to and communicating with the launching pits in the tubular cavities, wherein the priming holes are not connected to the annular grooves.

* * * * *